United States Patent [19]

Oyama

[11] Patent Number: 4,781,299

[45] Date of Patent: Nov. 1, 1988

[54] ROTARY SHELF

[75] Inventor: Nobuo Oyama, Chofu, Japan

[73] Assignee: Science and Technology Incorporated, Wilmington, Del.

[21] Appl. No.: 94,747

[22] Filed: Sep. 9, 1987

[30] Foreign Application Priority Data

Sep. 17, 1986 [JP] Japan ..... 61-219093

[51] Int. Cl.[4] ..... A47F 5/02

[52] U.S. Cl. ..... 211/144; 211/163

[58] Field of Search ..... 211/144, 163, 129, 131; 108/103; 312/135, 223

[56] References Cited

U.S. PATENT DOCUMENTS

| | | | |
|---|---|---|---|
| 2,344,650 | 3/1944 | Sloat | 211/144 X |
| 2,367,082 | 1/1945 | Amidon et al. | 211/144 |
| 2,493,538 | 1/1950 | Karns | 211/129 |
| 4,250,666 | 2/1981 | Rabestraw | 211/131 X |

*Primary Examiner*—Reinaldo P. Machado
*Assistant Examiner*—Sarah A. Lechok Eley
*Attorney, Agent, or Firm*—Stevens, Davis, Miller & Mosher

[57] ABSTRACT

This invention is a rotary shelf in which a shelf can rotate centering around a shaft which is put into one of two stationary holes opened at a face to be set through a square bottom face of a shelf.

4 Claims, 4 Drawing Sheets

ROTARY SHELF

BACKGROUND OF THE INVENTION

1. Field of the Invention

The present invention relates to a rotary shelf in which articles to be housed can be freely taken in and out, and more specifically to a rotary shelf used for shelves for cultivating plants, housing parts, displaying goods, cultivating bacteria in a biological room, etc.

2. Brief Description of the Prior Art

There have been various types of shelves used for housing and displaying goods and putting them in order; e.g., a stationary shelf, a rotary shelf.

The stationary shelf in a square shape among the conventional shelves is, for example, placed at a corner of a room as shown in FIG. 6, in which when the two faces j, k of the stationary shelf M are placed close to the wall face W of the surrounding wall of the room, goods can not be taken in and out from each face j, k. In order to take goods in and out from each face j, k, it is required to provide a passage (space) between each face j, k and the wall face W. Thus, a place having sufficient width for such a passage becomes necessary.

Further, in case that it is necessary to uniformly apply a light to the whole four faces j, k, l and m of the stationary shelf M, it is necessary to provide a distance between the two faces j, k and the wall face W, so that in this case, wide spaces to such an extent becomes necessary.

Of course, there have been known rotary-type or movable-type shelves. However, in these shelves, rotating axis or moving direction is previously determined and therefore, changes according to use and objects could not be made.

SUMMARY OF THE INVENTION

The object of the present invention is to provide a rotary shelf in which one can selectively choose a rotating axis of a shelf.

Another object of the present invention is to provide a shelf which can be effectively placed at a corner portion of a room by applying it to a shelf having square bottom face.

Still another object of the present invention is to provide a rotary shelf which can easily change rotary axes by just an operation of taking out a shaft from or putting it in one of shaft holes opened on the bottom face of a shelf.

Other objects of the present invention will become made apparent from the brief description and accompanying drawings.

DETAILED DESCRIPTION OF THE INVENTION

Figure 1:
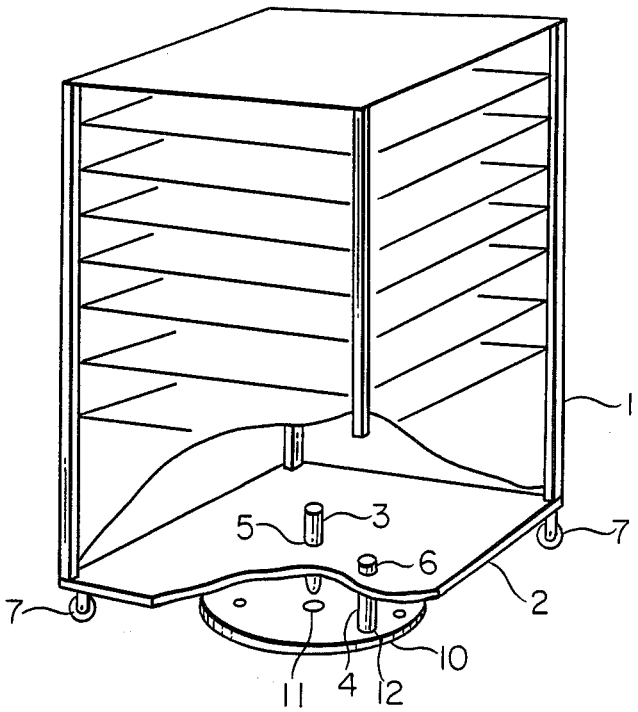
FIG. 1 is an explanatory view showing shelves of the present invention.

FIG. 1 shows an example of a rotary shelf of the present invention. A shelf 1 shown in this figure is an example of a multi-stage shelf body in which poles 8 are provided at the four corners of a bottom plate 2 equipped with casters 7 at the four corners of its bottom and shelf plates 9 are provided across and between the four poles 8,8. Of course, it may be possible to use a shelf in a square cylinder-shape having each opening side or a shelf inside of which is provided longitudinal and transverse partitions.

The bottom plate 2 of the rotary shelf 1 is a square shape.

Figure 2A:
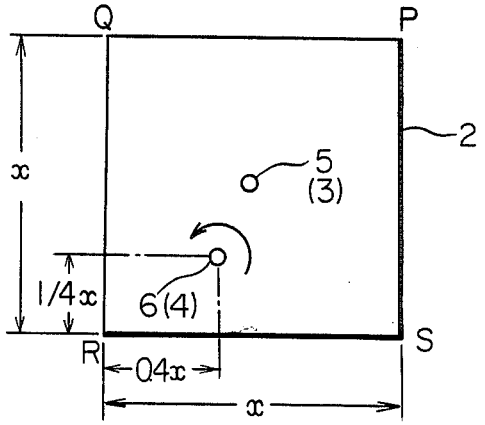
FIGS. 2A, 2B are plan views showing an operation explanation of the rotary shelves of the present invention.

In FIG. 2, a shaft hole 5 is opened at a crossing point of lines connecting corner portions Q-S and corner portions R-P opposing to each other at the bottom plate 2, i.e., diagonal lines, and another shaft hole 6 is opened at a position which is non-aligned in relation to diagonal line P-R and at a determined distance from the crossing point of the diagonal lines that locate the shaft hole 5. The preferable position of the shaft hole 6 is a point on the co-ordinate which is, when a length of one side of the bottom plate 2 is assumed to be $\chi$, exists a distance of $\frac{1}{4}\chi$ toward one side containing, e.g., a corner portion R and a distance of $0.4\chi$ toward the other side, as shown in FIG. 2A. Although the position of the shaft hole 6 is explained by referring the corner R as the standard, it goes without saying that the same effect can be obtained by setting the position of the shaft hole 6 to be opened, at any one of the other corner portions, P, Q and S.

In FIG. 1, a bearing base 10 is provided at a place on which a rotary shelf 1 of the present invention is to be placed e.g., a floor in a room. Stationary holes 11, 12 are opened in the bearing base 10 at places respectively corresponding to the shaft holes 5,6 of the bottom plate 2. In FIG. 1, reference numeral 3 is a first shaft which is pivoted at the stationary hole 11 through the shaft hole 5; and a refference numeral 4 designates a second shaft 2 which is pivoted at the stationary hole 12 through the shaft hole 6.

When the shaft 3 is put in the stationary hole 11, the rotary shelf 1 become rotatable centering around the shaft 3. On the other hand, when the shaft 4 is put in the stationary hole 12, the shelf 1 becomes rotatable centering around the shaft 4.

Figure 2B:
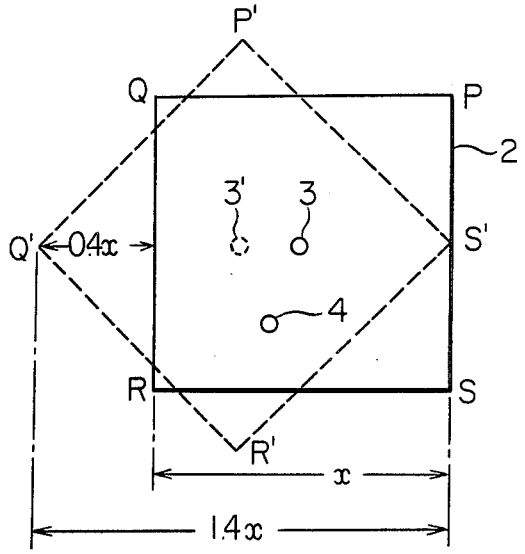

FIG. 2B shows a state that the shelf 1 is clockwisely turned at 45° from a state of the shelf 1 as shown in FIG. 2A. In FIG. 2B, by setting the shaft hole 6 at the specified position, the side P'S' of the bottom plate 2 after the turning exists on a line containing the corner portion S which is the original position, thus there is no case extending outwardly. It is same when the shelf 1 is turned from the state of FIG. 2B to that of FIG. 2A. This means that even when there is a wall face along the side P'S', there is no risk that the turning is obstructed by this wall face, so that effective turning in this position the position can be made.

Figure 4A:
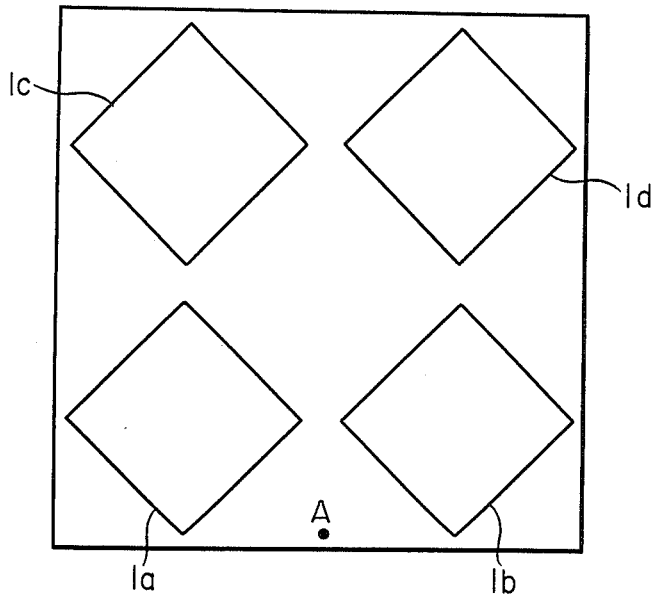
FIGS. 4A, 4B and 5 is a plan view showing operation and explanation of the rotary shelf of FIG. 1.
Figure 4B:
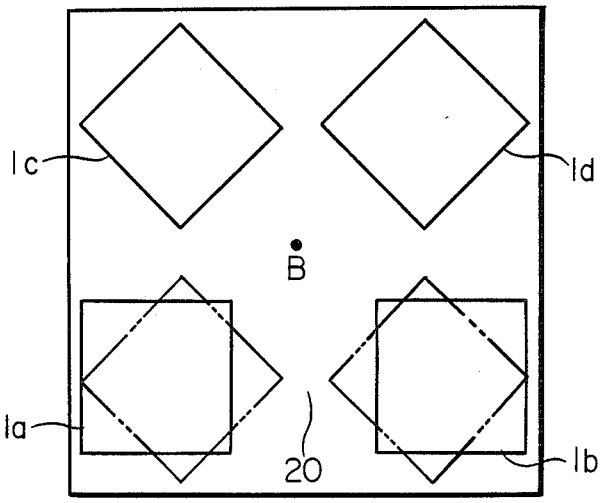
Figure 6:
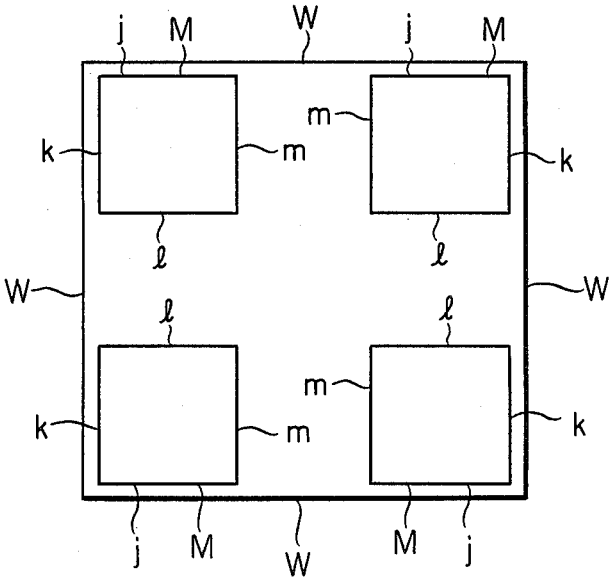
FIG. 6 is a plan explanatory view showing a conventional view.

FIGS. 4A, 4B show an example of the subject shelf as part of a set. When the rotary shelves 1*a* to 1*d* of the present invention are set at the four corners in a square room similar to FIG. 6, each of the rotary shelves 1*a* to 1*d* can be set at its arbitrary posture change and thus space can be saved in the room. For example, shelves 1*a* to 1*c* in a crucial shape are so arranged to make one corner of each shelves 1*a* to 1*d* face to the wall face of the room; therefore, a worker works at point A when he takes out objects to be housed from or put it into rotary shelves 1*a* and 1*b*.

On the other hand, in case that the worker desires to use shelves 1*c* and 1*d* he will work at B point as shown in FIG. 4B, and the shelf 1*a* is turned to the left at 45° centering around the eccentric rotary shaft 4 and the shelf 1*b* is turned to right at 45° centering around the second shaft 4; then, both the shelves 1*a* and 1*b* are rotated from the positions thereof shown by a chain line to the position shown by the solid line. Then, each side of the shelf 1*a*, 1*b* become parallel to the wall face and a passage 20 is formed between the both shelves 1*a*, 1*b* as shown in FIG. 4B. The worker moves to B point through the passage 20 and can operate there.

Figure 5:
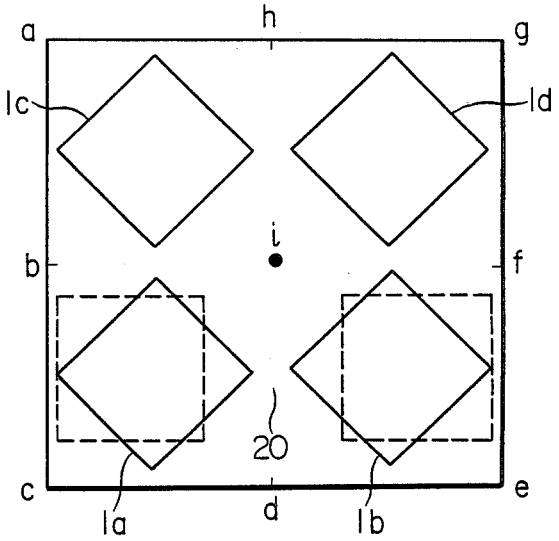

When the shelf 1 is used for growing plants and cultivating bacteria, each shelf 1*a* to 1*d* is arranged as shown in FIG. 5 and source is provided at each corner of the wall of the room, centers of each side and centers of the room, a to i, so that light can be uniformly applied to the whole of four faces of the shelf 1. For the above arrangements, such problems never occur that when goods are housed in the same shelf 1, application of light becomes non-uniform or inaccurate development in growing of plants or in cultivation of bacteria are not expected at certain places to be housed.

In case that there is no limitations such as the wall face in setting the shelf in the present invention, it goes without saying that the first shaft 3 is put into the stationary hole 11 and the shaft 3 is freely turned, the rotation centering about the shaft 3.

Figure 3A:
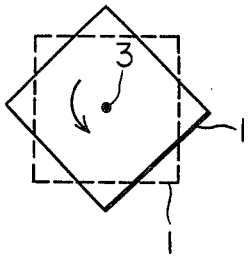
FIGS. 3A, 3B are plan view showing an operation explanation of other rotary shelves of the present invention.
Figure 3B:
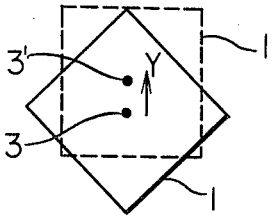

In this Example as shown in FIG. 2B, in order to avoid the extension of a part of the shelf from a predetermined line at the positions before and after the posture change where the rotary shelf is turned at 45°, two shafts are provided on the bottom plate 2 of the shelf. However, it is not necessrily do so. As apparent from FIG. 2B, when □ RSPQ is turned for 45° centering around the second shaft 4 to change the posture of the shelf to ◇ R'S'P'Q', the first shaft 3 at the center of the first shaft 3 changes its position to a position 3'. Therefore, the shaft 3 can be pivotted at the positions 3 or 3', and similar effects can be obtained. FIGS. 3A, 3B show an example of the above. In other words, in case where the bottom plate 2 is supported by the shaft 3 as shown in FIG. 3A, the shaft 3 is pulled out of the hole and the shelf is moved is a straight line as indicated by arrow Y. Then, at the position 3', the shaft 3 is pivotted in the fixing hole of the face on which the shelf is set.

According to the present invention, the shelf can be freely change directions by using the two points of a center portion of the shelf and a position which is apart from said center portion, as a turning shaft. Moreover, by selecting the shaft, even when the shelf is arranged near the wall face, the change of the posture is possible without being obstructed by this wall face. Still further, when the shelves are arranged at each corner of a room, a space for working, and a passage can be formed or light can be uniformly applied to each face by selecting the direction of each shelf.

The present invention can be widely utilized as shelfs for housing, displaying, making in order goods, articles, etc. or for caltivation in biochemical room, and in other uses.

What is claimed is:

1. A rotary shelf comprising:

a shelf body having a lowermost shelf, caster means on said lowermost shelf for vertically supporting said lowermost shelf and permitting horizontal movement thereof;

a base under said lowermost shelf, means to form a rotary pivot connection between said lowermost shelf and said base comprising said base or said lowermost shelf having at least two stationary openings, one opening being approximately under the center of said shelf body and the other opening being spaced therefrom;

at least one shaft mounted for vertical up and down movement and projecting from the one of said lowermost shelf or said base not having said at least two openings so as to be releasably engageable in either of said two opening so that said shelf body may be rotated about either opening when a shaft is engaged in that opening.

2. The rotary shelf of claim 1 in which the shelf body is a generally square shape when viewed from the top and one of the aligned positions of the shaft and openings is at a crossing point of the diagonal lines of the square.

3. The rotary shelf of claim 1 including two shafts, one aligned with and engageable with each of said two openings.

4. The rotary shelf of claim 1 in which the shelf body is a generally square shape when viewed from the top with one side of said square being of a length X, one of said opening is at the center of the square and the location of the other of said opening is spaced at a position of 0.4X from one side of the square and 0.25X from an adjacent side of the square.

* * * * *